US008701543B2

(12) United States Patent
Brinkmeyer et al.

(10) Patent No.: US 8,701,543 B2
(45) Date of Patent: Apr. 22, 2014

(54) ADJUSTABLE GAS SYSTEM FOR FIREARMS

(75) Inventors: Nathan A. Brinkmeyer, Davenport, IA (US); Anthony A. McVietty, Davenport, IA (US)

(73) Assignee: Armalite, Inc., Coal Valley, IL (US)

( * ) Notice: Subject to any disclaimer, the term of this patent is extended or adjusted under 35 U.S.C. 154(b) by 126 days.

(21) Appl. No.: 13/561,606

(22) Filed: Jul. 30, 2012

(65) Prior Publication Data

US 2014/0076150 A1 Mar. 20, 2014

Related U.S. Application Data

(60) Provisional application No. 61/531,345, filed on Sep. 6, 2011.

(51) Int. Cl.
*F41A 5/28* (2006.01)

(52) U.S. Cl.
USPC ..... 89/193; 89/191.01; 89/191.02

(58) Field of Classification Search
USPC ..... 89/191.01, 191.02, 193
See application file for complete search history.

(56) References Cited

U.S. PATENT DOCUMENTS

| | | | | | |
|---|---|---|---|---|---|
| 1,431,059 | A | * | 10/1922 | Sutter | 89/193 |
| 1,598,360 | A | | 8/1926 | Pavek | |
| 2,058,897 | A | * | 10/1936 | Marek | 89/193 |
| 2,732,769 | A | * | 1/1956 | Simpson | 89/193 |
| 2,748,662 | A | * | 6/1956 | Simpson | 89/193 |
| 2,869,272 | A | | 1/1959 | Coyle | |
| 2,883,781 | A | | 4/1959 | Harvey | |
| 2,900,878 | A | * | 8/1959 | Nomar | 89/189 |
| 2,956,481 | A | | 10/1960 | Barr et al. | |
| 4,433,611 | A | * | 2/1984 | Baumann | 89/193 |
| 4,501,189 | A | * | 2/1985 | Brandl et al. | 89/14.4 |
| 4,577,793 | A | * | 3/1986 | Jochum | 227/10 |
| 5,425,298 | A | | 6/1995 | Coburn | |
| 6,318,230 | B1 | | 11/2001 | Bamber | |
| 6,899,008 | B2 | | 5/2005 | Breuer | |
| 7,610,844 | B2 | * | 11/2009 | Kuczynko et al. | 89/193 |
| 7,694,619 | B2 | | 4/2010 | Beretta | |
| 7,832,326 | B1 | * | 11/2010 | Barrett | 89/191.01 |
| 7,891,284 | B1 | * | 2/2011 | Barrett | 89/193 |
| 7,971,518 | B2 | * | 7/2011 | Adams | 89/191.01 |
| 8,393,259 | B2 | * | 3/2013 | Larue | 89/193 |
| 8,596,185 | B1 | * | 12/2013 | Soong et al. | 89/193 |
| 2008/0307954 | A1 | * | 12/2008 | Fluhr et al. | 89/193 |

(Continued)

OTHER PUBLICATIONS

Operator's Manual for RIFLE, 7.62MM Supersass, 2006, Armalite Inc., Cover page, pp. 3, 15-16, 19, 46-47.

(Continued)

*Primary Examiner* — Bret Hayes
*Assistant Examiner* — Derrick Morgan
(74) *Attorney, Agent, or Firm* — Woodard, Emhardt, Moriarty, McNett & Henry LLP

(57) ABSTRACT

This application discloses a firearm gas system that includes a gas block that defines a gas port and a passage that receives a gas tube and an orifice plate that defines at least two orifices, where the orifice plate is positioned between a gas port in the barrel and the gas port on the gas block and where the orifice plate is movable with respect to the gas ports in the barrel and gas block to selectively position one of the orifices between the gas ports in the barrel and gas block where the orifices in the orifice plate have different orifice sizes.

20 Claims, 13 Drawing Sheets

(56) References Cited

U.S. PATENT DOCUMENTS

| | | | | |
|---|---|---|---|---|
| 2009/0229454 | A1* | 9/2009 | Fluhr et al. | 89/193 |
| 2011/0023699 | A1* | 2/2011 | Barrett | 89/193 |
| 2011/0179945 | A1* | 7/2011 | Clark et al. | 89/193 |
| 2012/0167756 | A1* | 7/2012 | Larue | 89/193 |
| 2012/0167757 | A1* | 7/2012 | Gomez | 89/193 |
| 2013/0098235 | A1* | 4/2013 | Reinken | 89/193 |
| 2013/0174721 | A1* | 7/2013 | Langevin et al. | 89/193 |

OTHER PUBLICATIONS

Operator's Manual for RIFLE, 7.62MM XM-110, 2005, ArmaLite, Inc., Cover page, pp. 2-3, 13-16, 21, 46-47.

* cited by examiner

ADJUSTABLE GAS SYSTEM FOR FIREARMS

CROSS-REFERENCE TO RELATED APPLICATIONS

This application claims the benefit of U.S. Provisional Application No. 61/531,345, filed Sep. 6, 2011, which is hereby incorporated by reference.

FIELD OF THE INVENTION

Aspects of the present disclosure deal with an adjustable gas system for firearms.

BACKGROUND OF THE INVENTION

Certain "direct impingement" or "external piston" gas operated rifles, i.e. semi-automatic or automatic rifles, use a barrel with a small hole or gas port that goes from the bore to the exterior. As the rifle is fired, gas flow is diverted through the gas port and is then channeled through a gas block, into either a gas tube or external piston which then transfers energy back into the bolt group in order to cycle the firearm for the next round. In certain situations it is desirable to control the amount of gas which can pass through the hole in the barrel to provide more or less force. For example, less force may be desired if a suppressor is used with the firearm, whereas more force may be desired if there is a build up of shot residue in the system. One method of controlling this pressure uses a valve attached to the return gas tube.

SUMMARY OF THE INVENTION

Certain embodiments of the present disclosure discloses a firearm gas system that includes a gas block that defines a gas port and a passage that receives a gas tube and an orifice plate that defines at least two orifices, where the orifice plate is positioned between a gas port in the barrel and the gas port on the gas block and where the orifice plate is movable with respect to the gas ports in the barrel and gas block to selectively position one of the orifices between the gas ports in the barrel and gas block where the orifices in the orifice plate have different orifice sizes to allow more or less gas and pressure to pass through the pathway.

DESCRIPTION OF PREFERRED EMBODIMENTS

Figure 1:
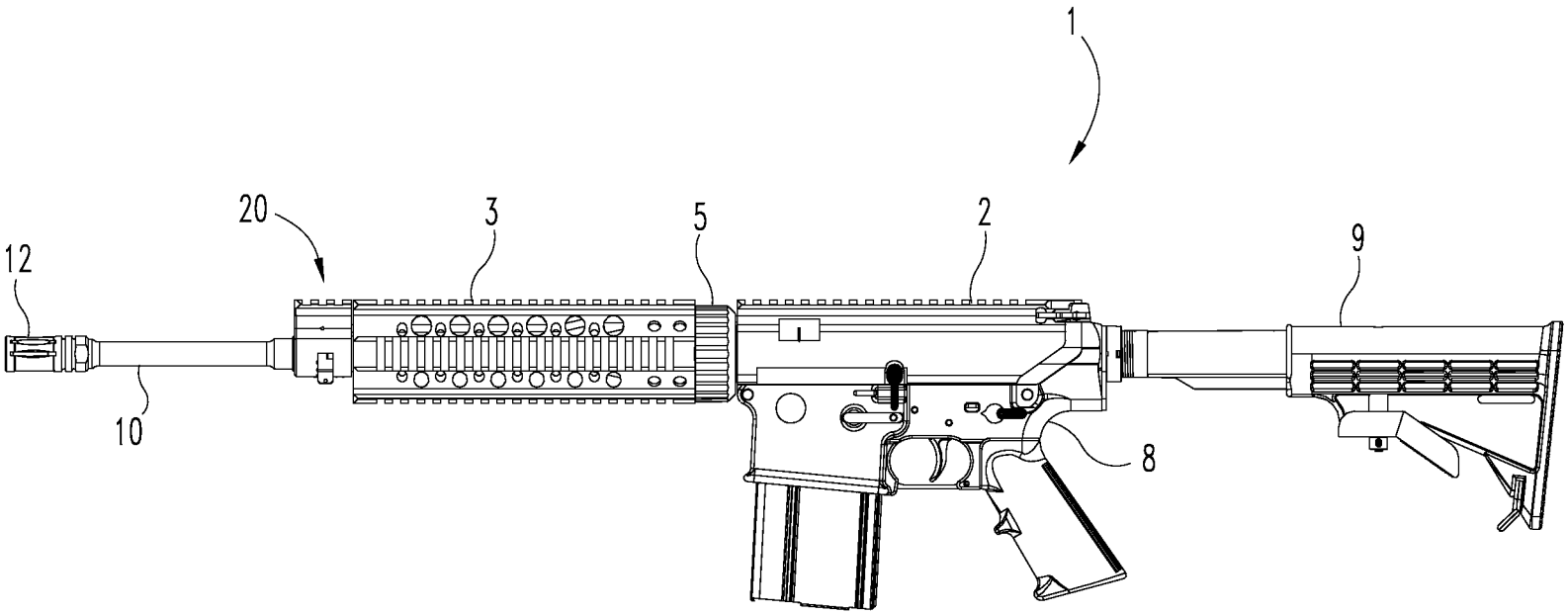
FIG. 1 is side elevational view of a firearm with a regulator arrangement.

For the purpose of promoting an understanding of the disclosure, reference will now be made to certain embodiments thereof and specific language will be used to describe the same. It will nevertheless be understood that no limitation of the scope of this disclosure is thereby intended, such alterations, further modifications and further applications of the principles described herein being contemplated as would normally occur to one skilled in the art to which the disclosure relates. In several FIGs., where there are the same or similar elements, those elements may be designated with the same or similar reference numerals.

Certain embodiments of the present disclosure use a gas regulator arrangement engaging a gas port in the barrel of a firearm to restrict the gas out-flow in incremental amounts at selected settings. One embodiment of the current disclosure include a ring shaped gas regulator which surrounds the barrel inside a gas block. The regulator ring includes a plurality of holes of different sizes which can be selectively aligned with the gas pathway between the barrel and a gas return tube to allow more or less gas and pressure to pass through the pathway.

Referring now to FIG. 1, firearm 1 is illustrated. Firearm 1 includes upper receiver 2, hand guard 3, locking ring 5, regulator arrangement 20, lower receiver assembly 8, stock 9, barrel 10 and flash suppressor 12 assembled in a conventional manner.

Figure 2:
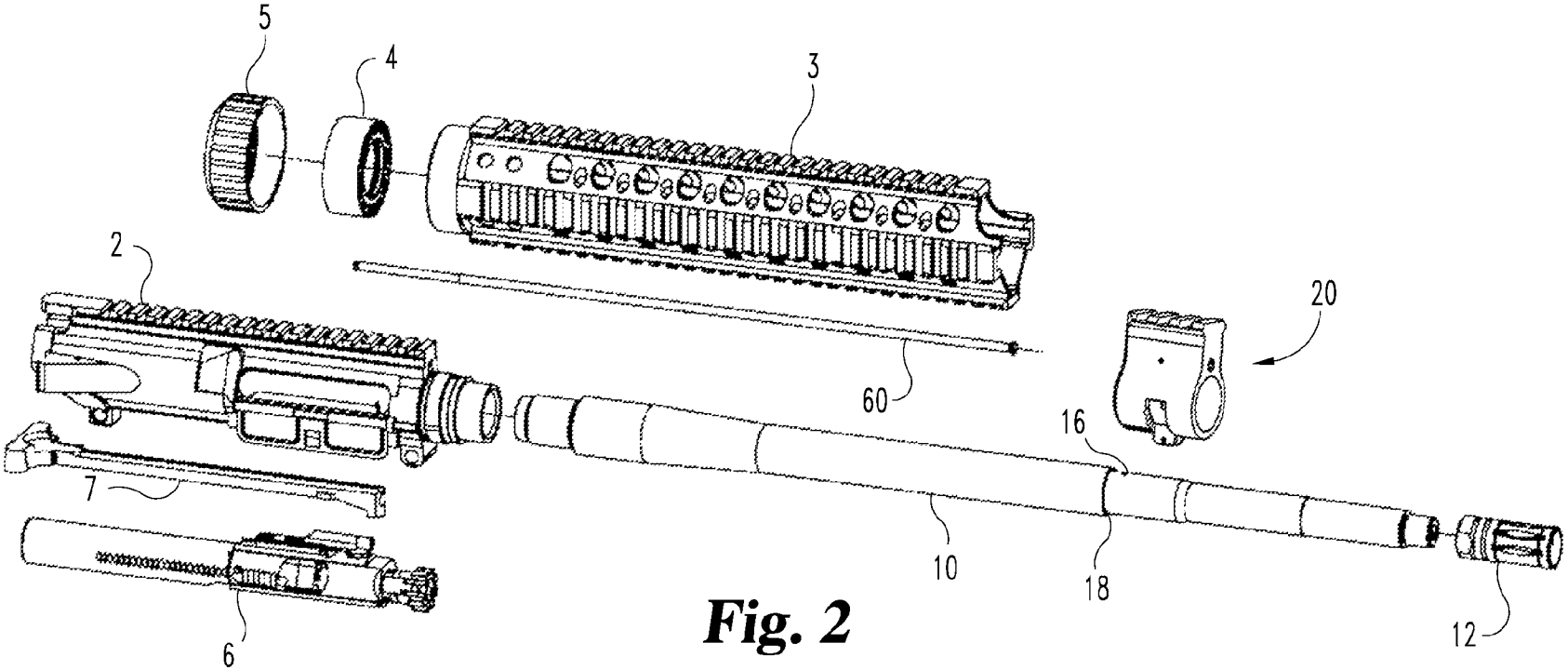
FIG. 2 is an exploded assembly view of the upper receiver assembly of the FIG. 1 firearm

Referring now to FIG. 2, an assembly view of the upper receiver is shown including upper receiver 2, hand guard 3, barrel nut 4, locking ring 5, bolt carrier assembly 6, charging handle 7, barrel 10, regulator arrangement 20 and gas tube 60.

Figure 3:
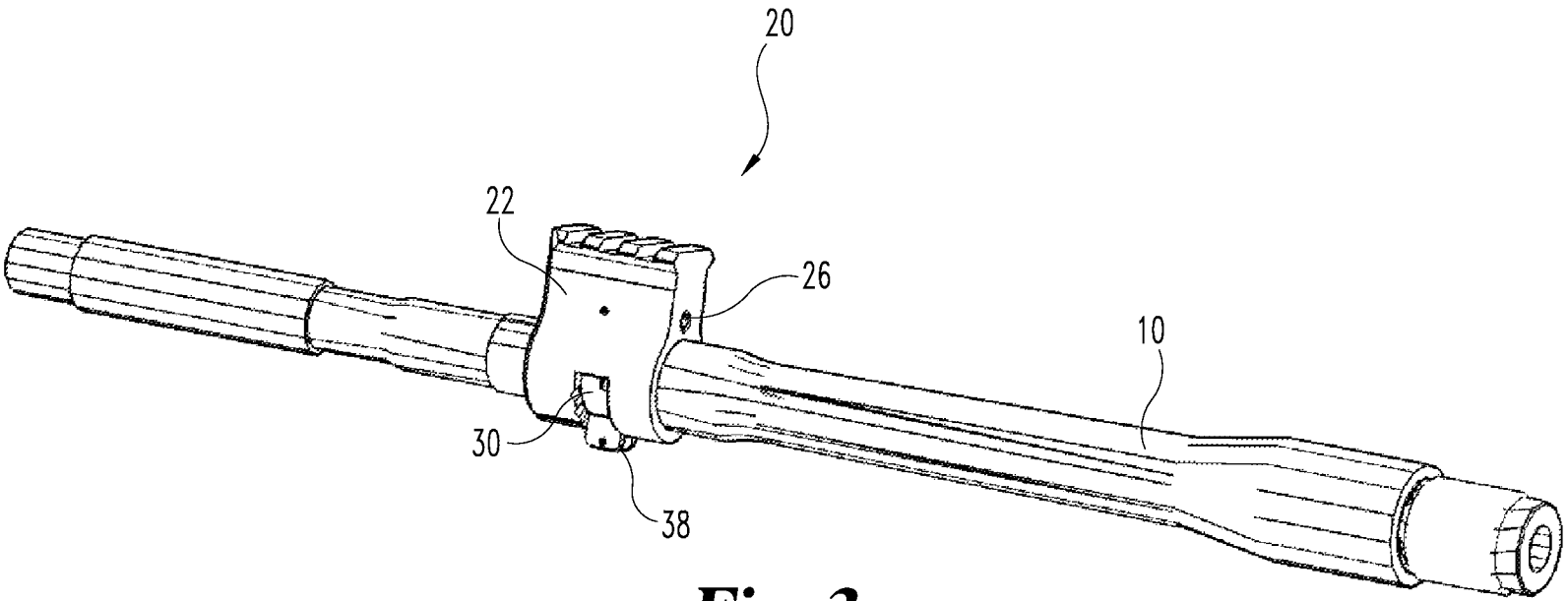
FIG. 3 is a perspective view of the FIG. 1 firearm barrel and regulator arrangement.
Figure 5:
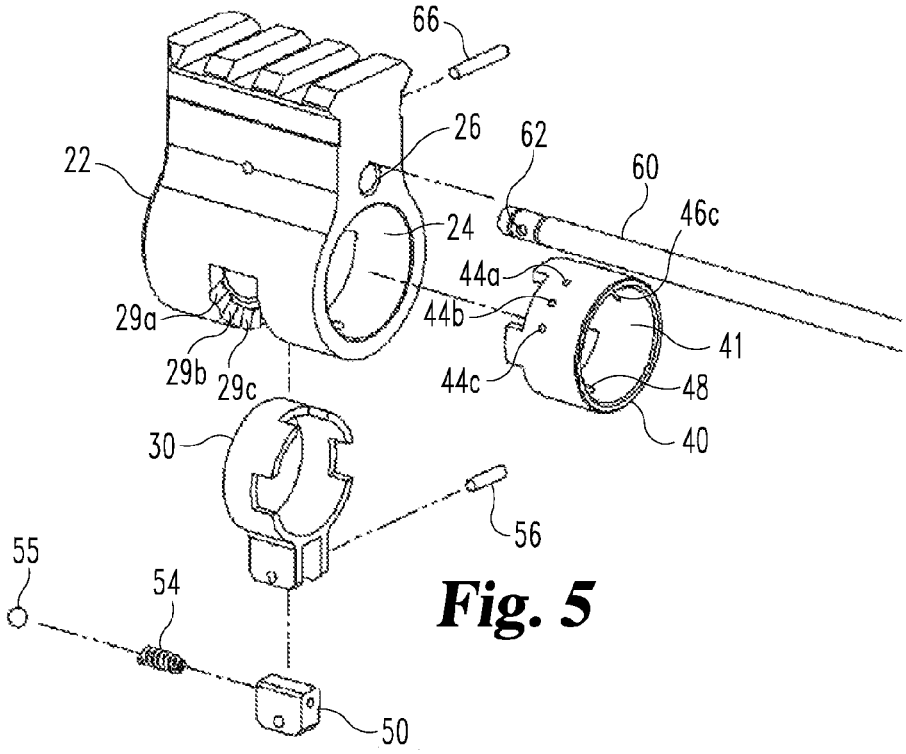
FIG. 5 is an exploded assembly view of the FIG. 1 regulator arrangement.
Figure 4:
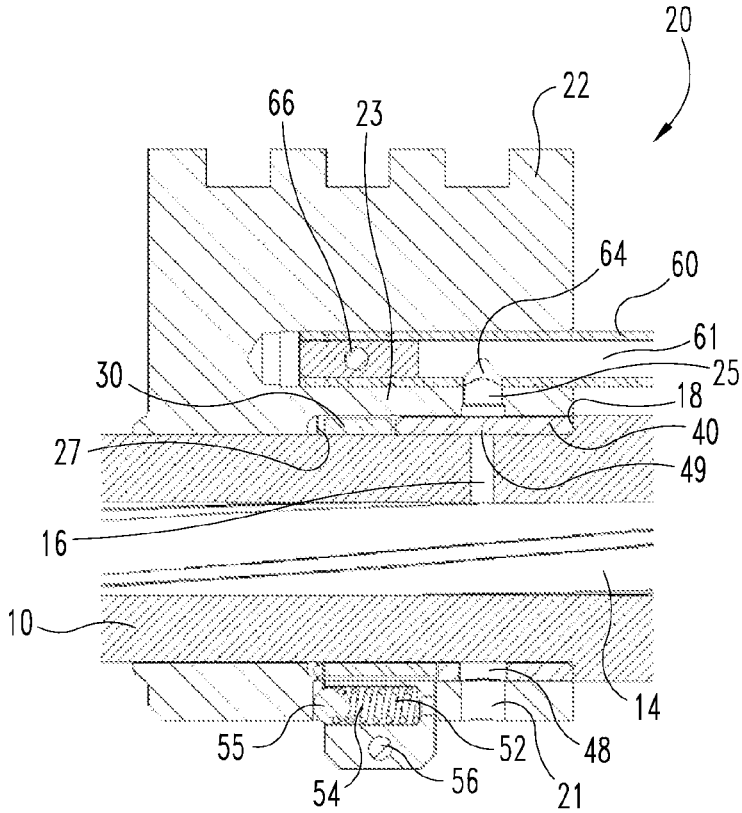
FIG. 4 is a cross-sectional view of the FIG. 1 firearm barrel and regulator arrangement.

Referring now to FIGS. 3-5, the assembly of regulator arrangement 20 on barrel 10 is shown. One embodiment of regulator arrangement 20 is illustrated mounted on barrel 10 in FIG. 3, in cross-section on barrel 10 in FIG. 4 and in an exploded view in FIG. 5. As shown, regulator arrangement 20 is typically mounted around firearm barrel 10.

Figure 6:
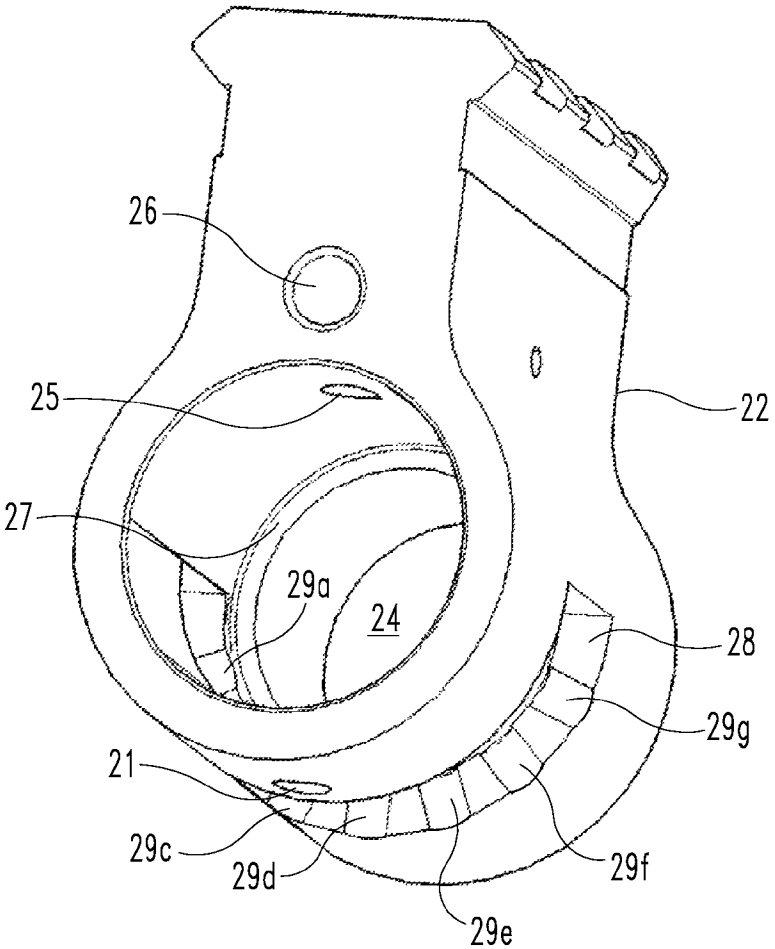
FIG. 6 is a bottom side perspective view of a gas block, a component of the FIG. 1 regulator arrangement.
Figure 7:
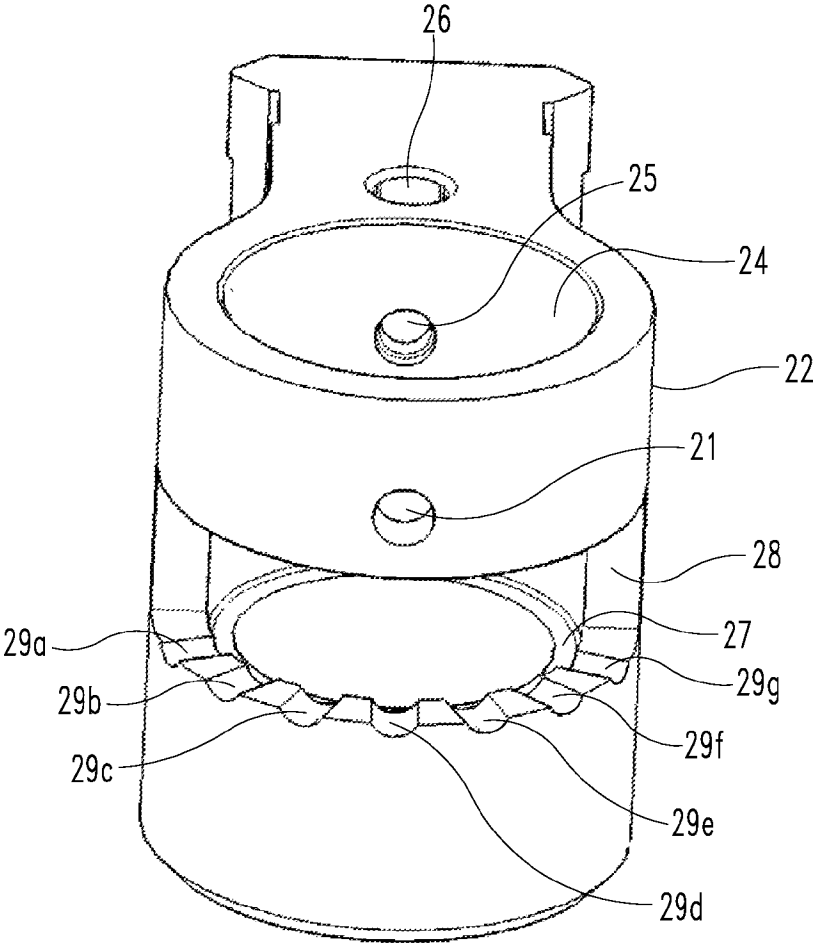
FIG. 7 is an bottom center perspective view of the FIG. 6 gas block.

Referring now to FIGS. 6 and 7, gas block 22 is illustrated. Gas block 22 defines passage 24 through which barrel 10 is arranged. Gas block 22 also defines a parallel offset gas tube passage 26 constructed and arranged to receive gas tube 60. Gas block 22 further defines opening 21 between passage 24 and the outside of gas block 22 and gas port 25 between passage 24 and passage 26. Gas port 25 and passage 26 are fluidly coupled. Gas port 25 is constructed and arranged to be aligned in a gas flow path between barrel gas port 16 and gas port 64 on gas tube 60.

Figure 8:
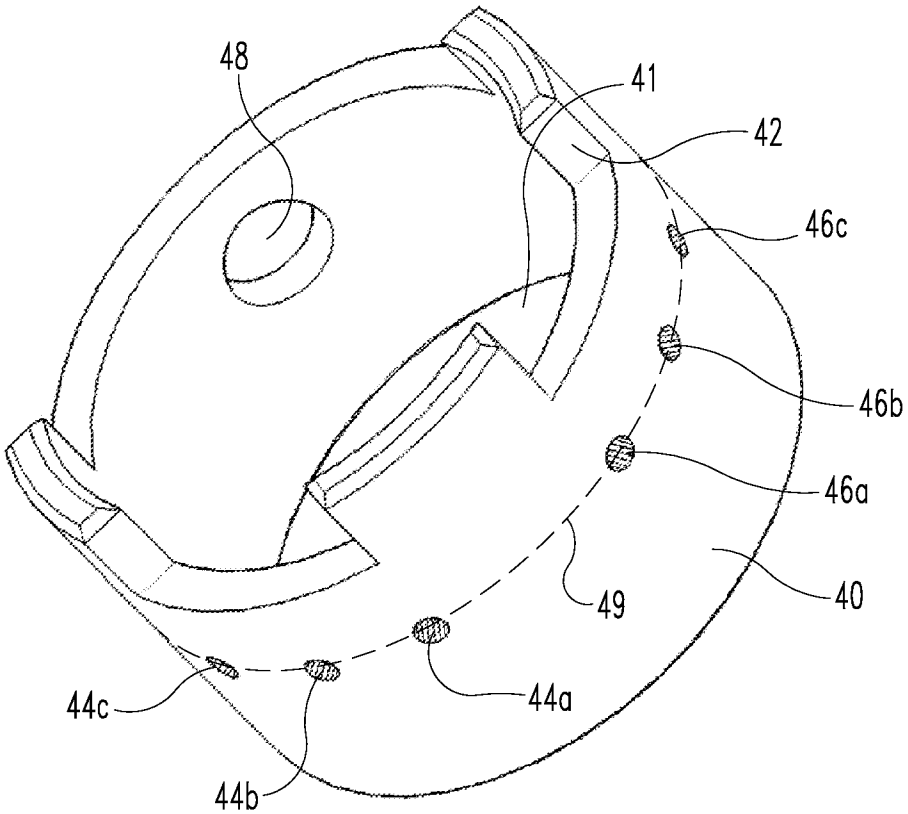
FIG. 8 is a front perspective view of a regulator ring, a component of the FIG. 1 regulator arrangement.
Figure 9:
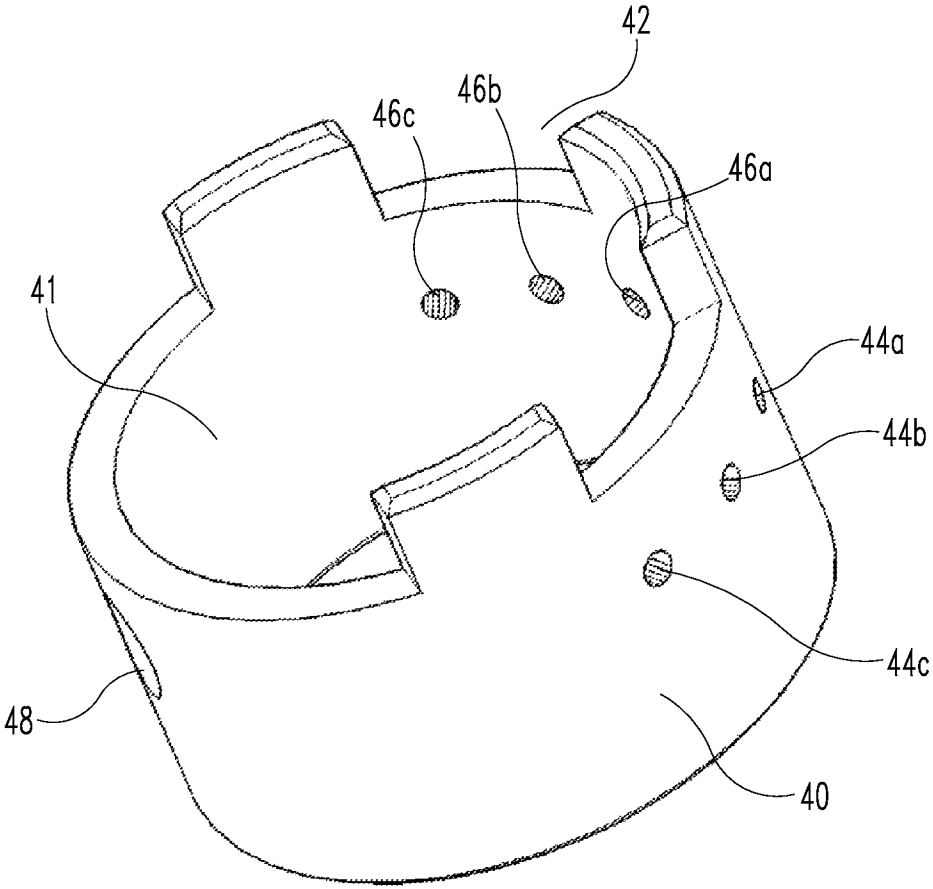
FIG. 9 is an side perspective view of the FIG. 8 regulator ring.

Referring now to FIGS. 8 and 9, regulator ring 40 is illustrated. Regulator ring 40 defines channel 41 constructed and arranged to encircle barrel 10. Regulator ring 40 further defines orifices 44*a*, 44*b*, 44*c*, 46*a*, 46*b* and 46*c* and opening 48 between channel 41 and the outside of regulator ring 40. In the illustrated embodiment, each of orifices 44*a*, 44*b*, 44*c*, 46*a*, 46*b* and 46*c* define a different sized orifice. Note that orifices 44*a*, 44*b*, 44*c*, 46*a*, 46*b* and 46*c* are arranged along a radial axis line defined by regulator ring 40 with a space between 44*a* and 46*a* that defines wall 49. One edge of ring 40 includes keyed portion 42 constructed and arranged to engagingly mate with keyed portion 32 on control ring 30 as described below.

While regulator ring 40 is disclosed as a cylindrical body that surrounds barrel 10, it should be understood that other configurations may be utilized in other embodiments. For example, regulator ring 40 could be replaced with a planar plate or with a curved plate with several orifices that are selectively positionable between port 16 and port 25. Regulator ring 40 is referred to as an orifice plate, and this term should be broadly understood to refer to any of the above described embodiments.

Figure 10:
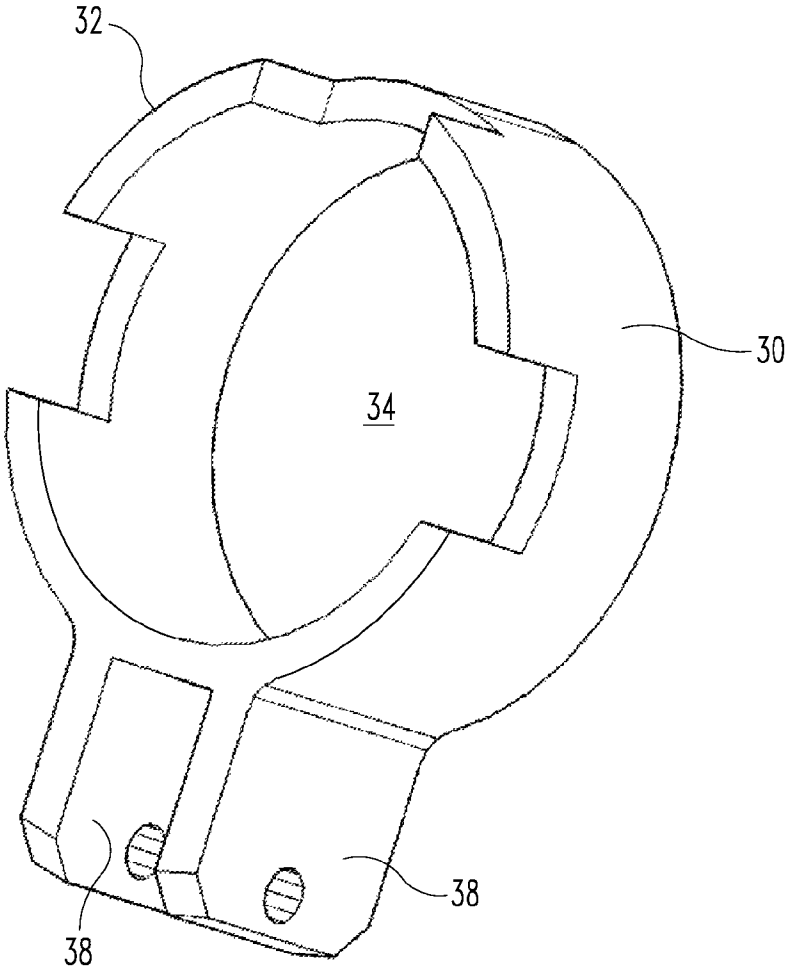
FIG. 10 is a perspective view of a control ring, a component of the FIG. 1 regulator arrangement.

Referring now to FIG. 10, control ring 30 is illustrated. Control ring 30 includes a rearward facing edge defining keyed portion 32 constructed and arranged to matingly engage keyed portion 42 of regulator ring 40 when assembled, such that rotation of control ring 30 around barrel 10 results in equivalent rotation of regulator ring 40 around barrel 10. Control ring 30 includes flanges 38 extending downward which can be selectively used to rotate ring 30. Control ring 30 is an actuator that is constructed and arranged to move an orifice plate such as regulator ring 40 to bring various orifices such as orifices 44*a*, 44*b*, 44*c*, 46*a*, 46*b* or 46*c* into alignment between port 16 and port 25.

Figure 11:
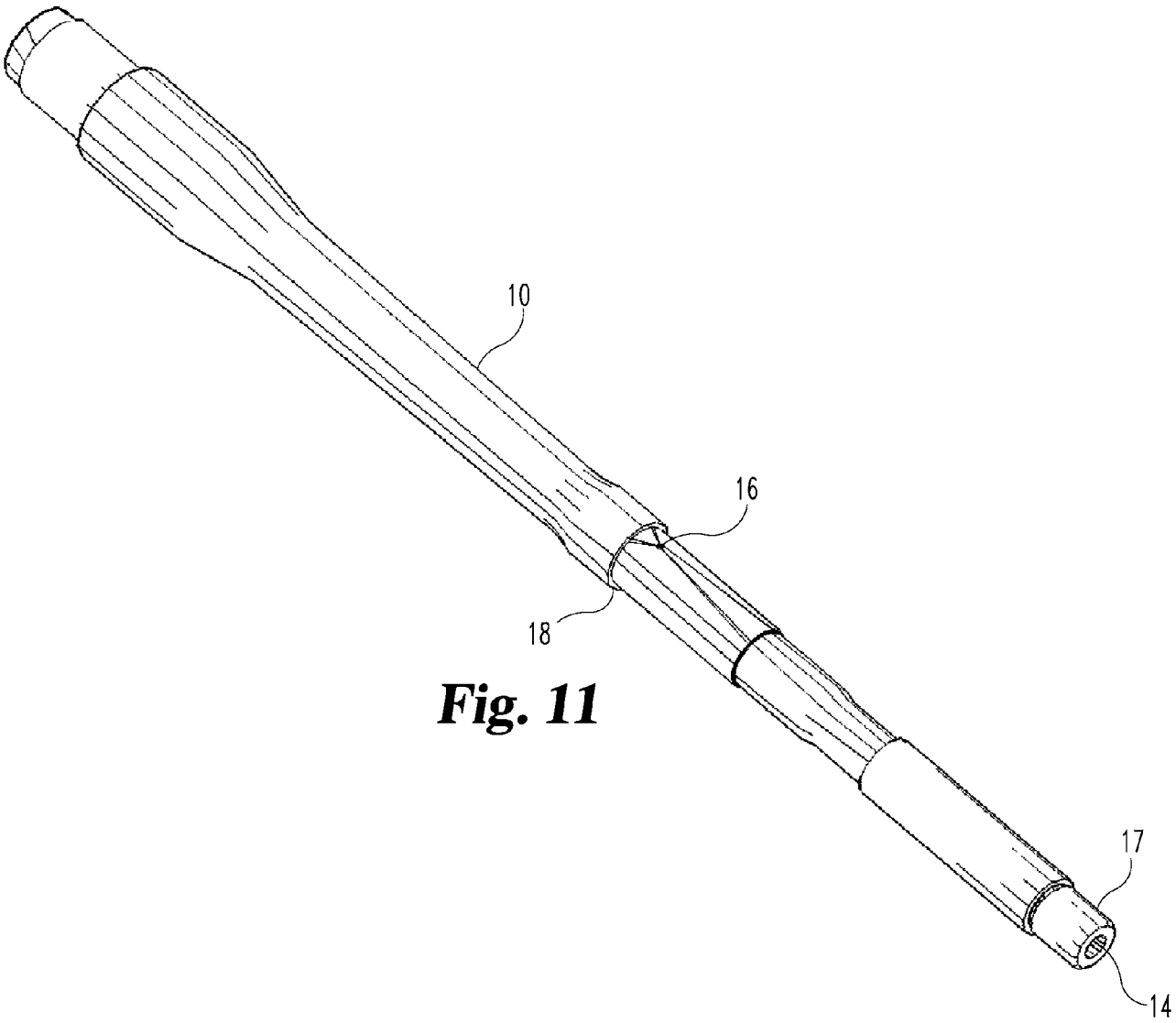
FIG. 11 is a perspective view of the FIG. 3 barrel.

Referring now to FIG. 11, barrel 10 is illustrated. Barrel 10 defines gas port 16, typically upward facing, extending from the bore 14 to the exterior of the barrel. Barrel 10 includes threaded portion 17 for attached objects such as flash suppressors and silencers. Barrel 10 also includes shoulder 18 proximate to gas port 16. As described below, shoulder 18 defines a surface that regulator ring 40 abuts against.

As shown in FIG. 5, gas tube 60 defines mounting hole 62. Mounting pin 66 extends at least partially through gas block 22 and gas tube 60 to secure gas tube 60 within passage 26. Gas tube 60 defines a typically downward facing gas port 64 from the bore 61 of the tube to the exterior of the tube. Gas tube 60 may be configured to deliver gas for direct impingement against bolt carrier assembly 6. This may be referred to as an internal piston system. Alternatively, gas tube 60 may be configured to deliver gas for impingement against a piston rod assembly located inside of the gas tube, where the piston rod is configured to receive the gas energy from the barrel and transfer that energy by impinging against bolt carrier assembly 6 (as described below with respect to FIG. 14). This type of system may be referred to as an external piston system.

Referring back to FIGS. 4 and 5, regulator arrangement 20 is assembled as follows. Control ring 30 is inserted through opening 28 and is positioned in gas block 22 with channel 34 aligned in passage 24 with flanges 38 passing through opening 28. Regulator ring 40 is then inserted into passage 24 on gas block 22 with keyed portion 42 on regulator ring 40 abutting and engaging keyed portion 32 on control ring 30. Gas block 22 (with regulator ring 40 and control ring 30) is then positioned on barrel 10 with regulator ring 40 abutting shoulder 18 with gas port 25 on gas block 22 aligned with gas port 16 on barrel 10. Gas block 22 may be secured to barrel 10 in any manner known to those skilled in the art. For example, gas block 22 may be drilled and pinned to barrel 10 as well known in the art (not illustrated). As shown in FIG. 4, control ring 30 and regulator ring 40 are axially entrapped between shoulder 18 on barrel 10 and shoulder 27 on gas block 22. However, both control ring 30 and regulator ring 40 may be rotated about barrel 10.

Optionally mounted between flanges 38 is detent housing 50 which can be secured to flanges 38, for example using mounting pin 56. Detent housing 50 defines cavity 52 within which is mounted spring 54 between a backwall of the cavity and a detent stop 55, such as a ball bearing or an at least partially spherical portion. In the assembled arrangement, detent stop 55 resiliently bears against a series of rearward facing detent points 29 defined in gas block 22 along opening 28. The detent stop 55 inhibits rotation of control ring 30 until a sufficient force is applied against flanges 38 to overcome the detent resistant force applied by spring 54 and to rotate control ring 30. Detent housing 50, spring 54 and detent stop 55 define a retention device that resists rotational movement of the orifice plate defined by regulator ring 40.

Regulator ring 40 preferably defines a series of orifices of different diameters, for example 44*a*, 44*b*, 44*c*, 46*a*, 46*b* and 46*c*. One orifice at a time can be selectively arranged in the gas flow path between barrel gas port 16 and gas port 64 on gas tube 60, so that the diameter of the selected orifice correspondingly allows or restricts gas flow from bore 14 through bore 61 when the firearm is fired. The six illustrated orifices are provided as an example, but more or less orifices of selected sizes may be used as desired. Alternate embodiments can be configured to selectively arrange more than one orifice within the gas flow path, or alternatively to arrange an orifice which is adjustable in size within the gas flow path.

Preferably, detent points 29*a*, 29*b*, 29*c*, 29*e*, 29*f* and 29*g* are calibrated to orifices 44*a*, 44*b*, 44*c*, 46*a*, 46*b* and 46*c*, etc. so that when control ring 30 is rotated to a selected detent point, regulator ring 40 is rotated so that a selected corresponding orifice is aligned in the gas flow path. Optionally, there may be more detent points 29 and rotational points for control ring 30 than there are orifices, for example allowing an "off" position, such detent point 29*d* aligned with wall 49, where no gas flow is allowed. As detent stop 55 moves between detent points 29*a*, 29*b*, 29*c*, 29*e*, 29*f* and 29*g*, alignment of one of the orifices 44*a*, 44*b*, 44*c*, 46*a*, 46*b* and 46*c* with the gap between ports 16 and 25 is indicated by the curved surface of detent stop 55 seeking the bottom of an individual detent point 29*a*, 29*b*, 29*c*, 29*e*, 29*f* or 29*g*. This preferential self centering nature provides tactile feedback to the operator. In addition, markings may be optionally provided proximate to detent points 29*a*, 29*b*, 29*c*, 29*e*, 29*f* and 29*g* to provide visual indication to the operator as to the gas system setting at a particular time.

When assembled, control ring 30, preferably with the detent housing already mounted, is introduced into passage 24 and detent stop 55 is arranged against a detent point 29 prior to mounting of gas block 22 on barrel 10. Regulator ring 40 can be arranged within passage 24 prior to introduction of barrel 10, or may be placed on barrel 10 and then advanced into passage 24 after barrel 10 is in place. Regulator ring 40 can be secured in place relative to passage 24 via friction fit, using a fastener or via bearing pressure against another component of the firearm.

Once arrangement 20 is assembled and in place, an operator can manually press upon one or both flanges 38 to rotate control ring 30 and regulator ring 40 clockwise or counter clockwise within the limits of opening 28. Preferably detent stop 55 engages detent points 29*a*, 29*b*, 29*c*, 29*e*, 29*f* and 29*g* one at a time to retain control ring 30 in selected orientations and correspondingly to align a selected orifice, or no orifice, within the gas flow path. Rotation of flange 38 is selectively controllable by the operator. Control ring 30 and regulator ring 40 are rotationally keyed together via keyed portions 32 and 42, so rotation of control ring 30 by movement of flange 38 results in comparable rotation of regulator ring 40.

Flanges 38 and/or detent housing 50 may optionally be coated with and/or constructed of a heat insulating material that may reduce the surface temperature of flanges 38 and/or detent housing 50 compared to barrel 10 or gas block 22.

Regulator arrangement 20 provides control over gas flow between bore 14 in barrel 10 and bore 61 in gas tube 60. As well known in the art, gas pressure tapped from gas port 16 is used to move bolt carrier assembly 6 to cycle the action between round firings. Control over the gas flow rate may be beneficial to allow easy optimization of the operation of firearm 1. The inventors have observed that adding a silencer to barrel 10 speeds up the cyclical rate of the action. Reducing the flow of gas from bore 14 to bore 61 allows use of a silencer while maintaining the cyclical rate of the action in an acceptable range. The silencer could then be removed and a different sized orifice could then be selected to maintain the cyclical rate of the action in an acceptable range without the silencer.

The illustrated regulator ring 40 includes two sets of 3 orifices on either side of wall 49: orifices 44*a*, 44*b* and 44*c* and orifices 46*a*, 46*b* and 46*c*. One group of three orifices can be optimized for normal (no silencer) configuration with the other group of three orifices optimized for suppressed (silencer attached) configuration. The three settings for each condition may be further optimized for different operating conditions such as reduced, nominal and adverse. The three setting may be configured to have similar cyclical rates between the two configurations. Normal setting may be configured for standard operating conditions. If the particular ammunition being used is running slow or fast, regulator arrangement 20 can be switched to reduce or increase the gas flow to normalize the cyclical rate. The adverse setting can also be used if the weapon is dirty from excessive firing or if sand, mud or any other debris is causing increased friction in the moving parts and more power is needed to maintain the cyclical rate of fire.

Openings 21 and 48 are optionally provided as a cleaning and/or lubrication access point. With regulator arrangement 20 aligned as shown in FIG. 4 with openings 21 and 48 aligned, a lubricant, cleaner or compressed air may be passed into opening 21 and/or opening 48 to help remove any buildup between barrel 10 and regulator ring 40. Misaligning openings 21 and 48 (e.g., by rotating regulator ring 40 with respect to gas block 22) allows access with a lubricant, clearer or compressed air to help remove any buildup between regulator ring 40 and gas block 22.

Figure 12:
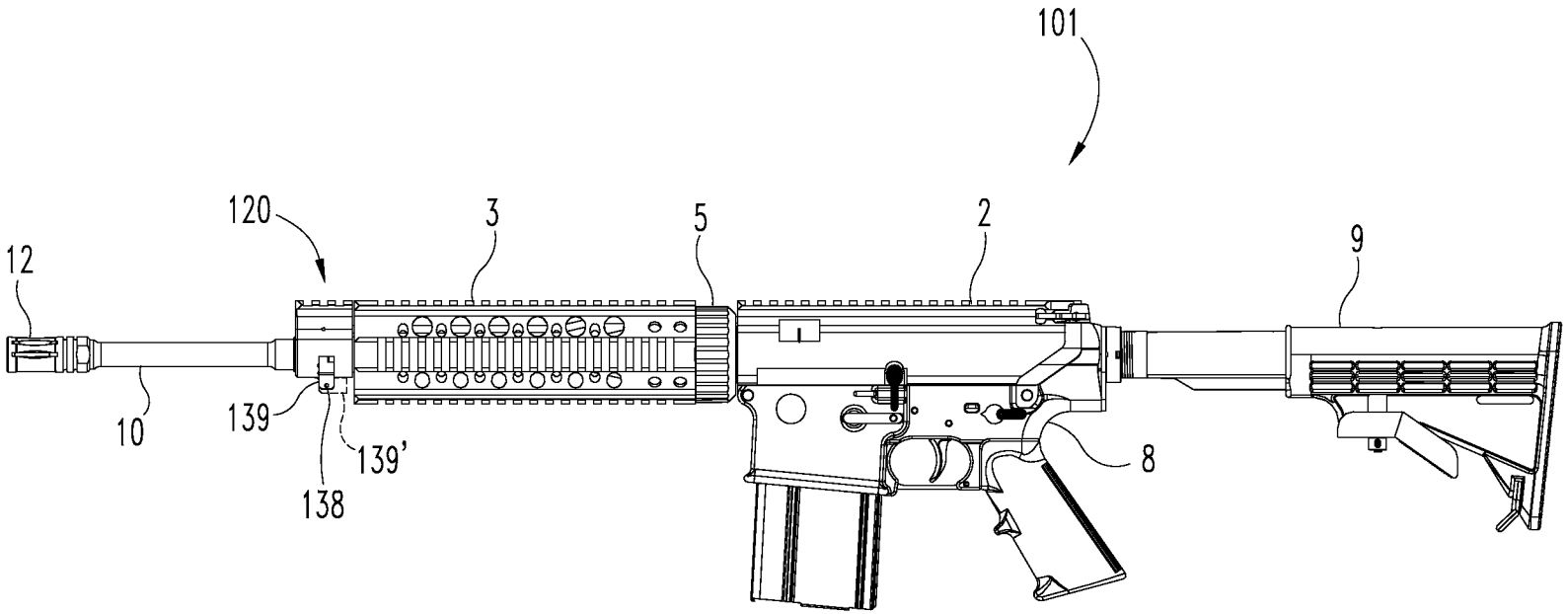
FIG. 12 is a side elevational view of an alternative embodiment of a regulator arrangement on a firearm.

Referring to FIG. 12, an alternative embodiment is illustrated as part of firearm 101. Firearm 101 includes upper receiver 2, hand guard 3, locking ring 5, regulator arrangement 120, lower receiver assembly 8, stock 9 and barrel 10 assembled in a conventional manner. Regulator arrangement 120 includes extension 139 extending from flanges 138. Extension 139 provides a longer moment arm to actuate movement of control ring 30 and regulator ring 40. Extension 139 may optionally be pivotally coupled to flanges 138, permitting extension 139 to be "stowed" in a recessed manner against the outer body of regulator arrangement 120 when not in use (as shown with dashed lines as stowed extension 139'). In this regard, extension 139 may optionally be biased with a spring mechanism (not shown) to reside in the "stowed" position when not in use to reduce inadvertent actuation of regulator ring 40. Alternatively, or in addition, a detent type mechanism may be used to maintain the position of extension 139 in the "stowed" position when not in use. Extension 139 is pivotable about an axis normal to the barrel.

Extension 139 may optionally be coated with and/or constructed of a heat insulating material that may reduce the surface temperature of flanges 38 and/or detent housing 50 compared to barrel 10 or gas block 22.

Figure 13:
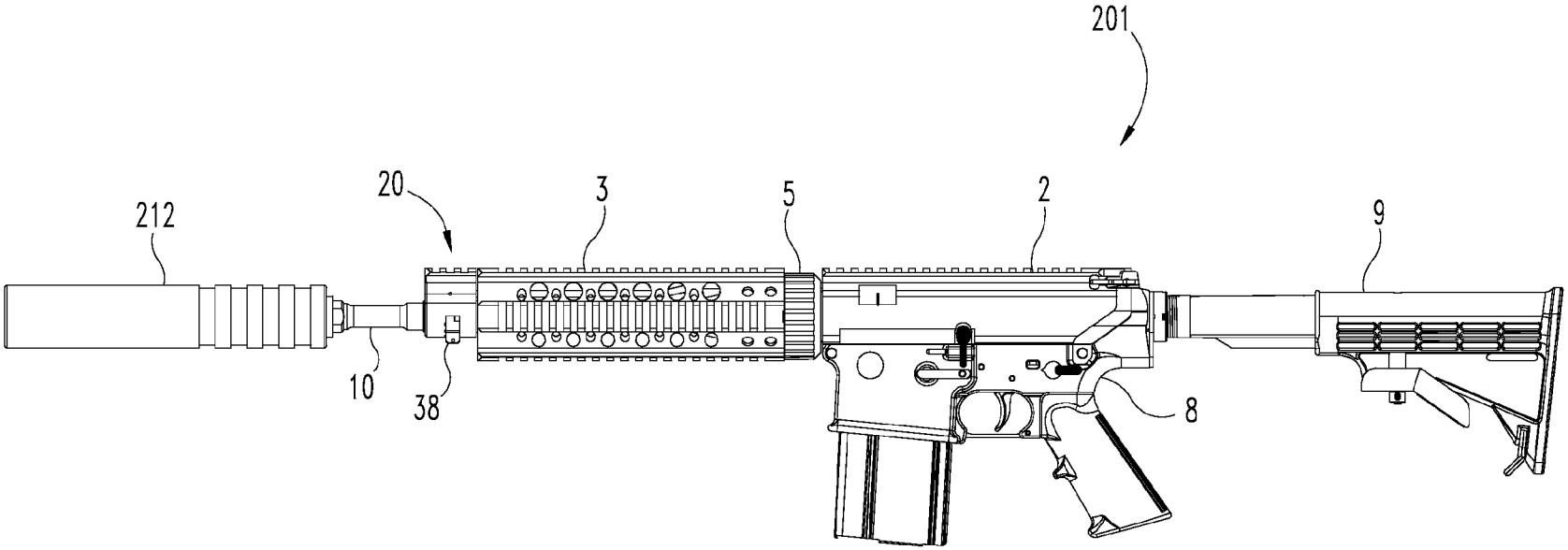
FIG. 13 is a side elevational view of a firearm with a silencer.

Referring to FIG. 13, firearm 201 is illustrated. Firearm 201 includes upper receiver 2, hand guard 3, locking ring 5, regulator arrangement 20, lower receiver assembly 8, stock 9 and barrel 10 assembled in a conventional manner. Firearm 201 also includes silencer 212 attached to barrel 10. Silencer 212 may be removable mounted to barrel 10 using threads as known in the art.

Figure 14:
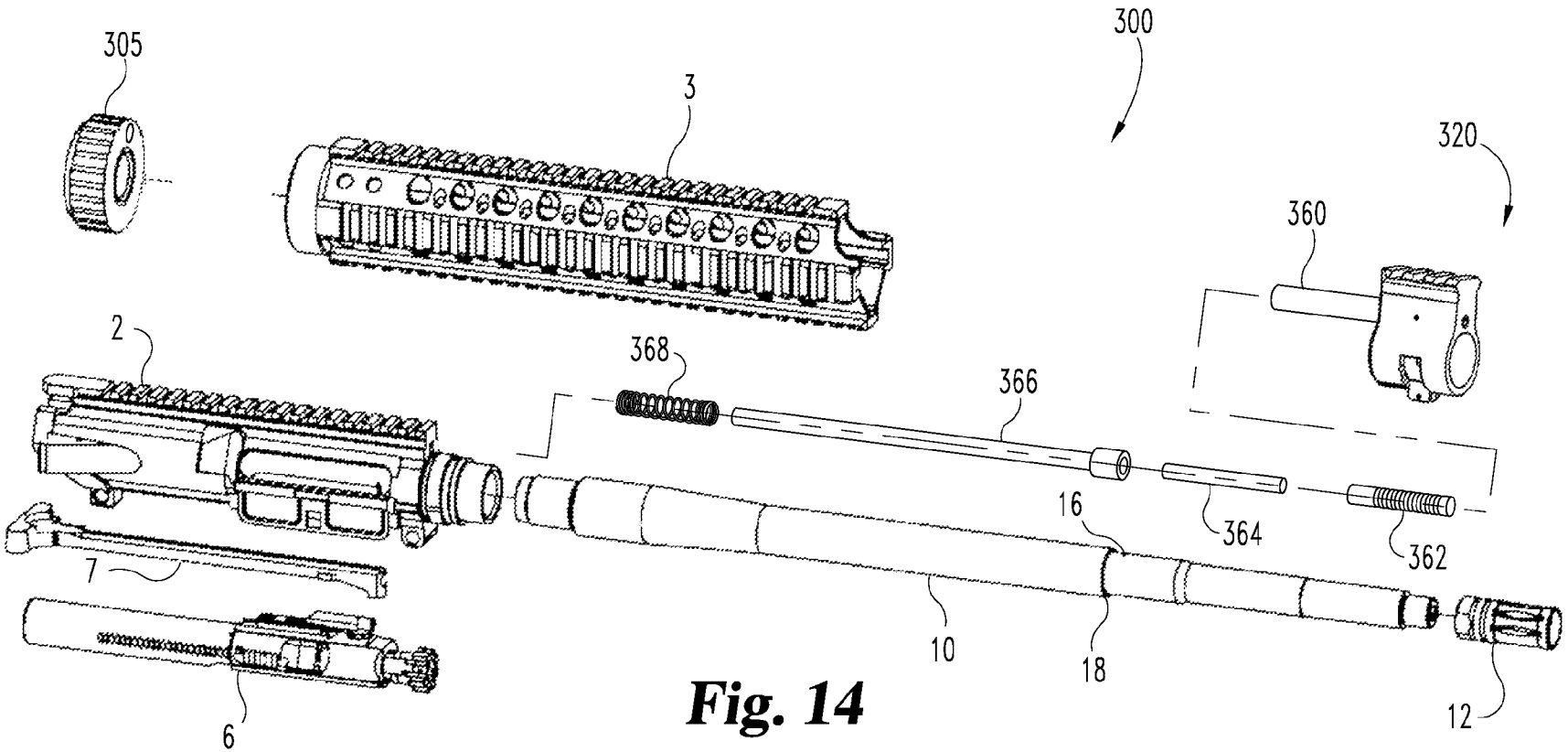
FIG. 14 is assembly view of an external piston gas system.

Referring to FIG. 14, an assembly view of an upper assembly with external piston system 300 is illustrated. External piston system 300 includes gas block 320, gas tube 360, piston 362, link rod 364, operating rod 366, spring 368 and barrel nut 305. Gas tube 360 acts as a piston cylinder for piston 362. Combustion gases are ported from barrel 10 through gas block 320 to gas tube 360 where the combustion gases impinge against piston 362, moving piston 362 rearward. Piston 362 pushed link rod 364 and operating rod 366 rearward with operating rod 366 pushing against bolt carrier 6 to cycle the action. This assembly replaces the direct gas impingement system disclosed above where gas is ported through gas tube 60 to directly impinge against bolt carrier 6. While FIG. 14 illustrates an internal piston arrangement, it should be understood that an external piston arrangement, with the piston extending around the gas tube instead of residing inside the gas tube, as known in the art, could also be used with the disclosed adjustable gas system.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

We claim:

1. A gas system for use with a gas tube, an upper receiver portion of a firearm and a barrel defining a bore and a first gas port, wherein the first gas port penetrates the barrel between an outer surface and the bore, the assembly comprising:

a gas block defining a second gas port and a passage constructed and arranged to operatively receive the gas tube and to fluidly couple the gas tube to the second gas port; and a curved orifice plate defining at least a first orifice and a second orifice, wherein the orifice plate is positioned between the first and second gas ports and is rotatable about the barrel to move the orifice plate with respect to the first and second gas ports to selectively position the first or second orifice between the first and second gas ports and wherein the first and second orifices have different orifice sizes.

2. The gas system of claim 1, further comprising an actuator constructed and arranged to move the orifice plate with respect to the first and second gas ports.

3. The gas system of claim 1, further comprising a retention device that resists movement of the orifice plate.

4. The gas system of claim 1, wherein the orifice plate is cylindrical.

5. The gas system of claim 4, further comprising a control ring rotationally keyed to the orifice plate.

6. The gas system of claim 5, further comprising a detent assembly constructed and arranged to resist rotational movement of the control ring.

7. The gas system of claim 6, further comprising a first detent recess constructed and arranged to cooperate with the detent assembly to align the first orifice between the first and second gas ports.

8. The gas system of claim 5, further comprising an extension coupled to the control ring, wherein the extension is pivotable about an axis normal to the barrel.

9. The gas system of claim 5, wherein the barrel and the gas block confine the control ring and the orifice plate.

10. The gas system of claim 9, wherein the control ring is rotatable about the barrel.

11. The gas system of claim 1, wherein the first orifice is sized to optimize the cycle time of the upper receiver portion when a silencer is coupled to the barrel and wherein the second orifice is sized to optimize the cycle time of the upper receiver portion when the silencer is removed from the barrel.

12. The gas system of claim 1, wherein the orifice plate defines a plurality of orifices.

13. A firearm comprising:

a barrel defining a bore and a first gas port, wherein the first gas port penetrates the barrel between an outer surface of the barrel and a bore of the barrel;

a silencer selectively attachable to the barrel;

a gas tube;

an upper receiver;

a gas block defining a second gas port and a passage constructed and arranged to operatively receive the gas tube and to fluidly couple the gas tube to the second gas port; and a curved orifice plate defining at least a first orifice and a second orifice, wherein the orifice plate is positioned between the first and second gas ports and is rotatable about the barrel to move the orifice plate with respect to the first and second gas ports to selectively position the first or second orifice between the first and second gas ports and wherein the first and second orifices have different orifice sizes, wherein the first orifice is sized to optimize the cycle time of the upper receiver portion when the silencer is attached to the barrel and wherein the second orifice is sized to optimize the cycle time of the upper receiver portion when the silencer is removed from the barrel.

14. The firearm of claim 13, wherein the orifice plate is cylindrical.

15. The firearm of claim 14, further comprising a control ring rotationally keyed to the orifice plate.

16. The firearm of claim 15, further comprising a detent assembly constructed and arranged to resist rotational movement of the control ring.

17. The firearm of claim 16, further comprising a first detent recesses constructed and arranged to cooperate with the detent assembly to align the first orifice between the first and second gas ports.

18. The firearm of claim 15, wherein the control ring and the orifice plate are axially entrapped between the barrel and the gas block.

19. The firearm of claim 13, further comprising an extension coupled to the control ring, wherein the extension is pivotable about an axis normal to the barrel.

20. The firearm of claim 13, further comprising a piston in the gas tube, wherein the piston is constructed and arranged to transfer energy from combustion gas in the gas tube to a bolt carrier in the upper receiver.

* * * * *